US007275287B2

(12) United States Patent
Kranefeld et al.

(10) Patent No.: US 7,275,287 B2
(45) Date of Patent: Oct. 2, 2007

(54) COILER PLATE FOR SILVER-COILING DEVICES, ESPECIALLY OF DRAW FRAMES AND CARDING MACHINES

(75) Inventors: Andreas Kranefeld, Erkelenz (DE); Thomas Landmesser, Erkelenz (DE)

(73) Assignee: Trutzschler GmbH & Co. KG, Monchengladbach (DE)

( * ) Notice: Subject to any disclaimer, the term of this patent is extended or adjusted under 35 U.S.C. 154(b) by 122 days.

(21) Appl. No.: 11/288,276

(22) Filed: Nov. 29, 2005

(65) Prior Publication Data

US 2006/0117531 A1 Jun. 8, 2006

(30) Foreign Application Priority Data

Dec. 3, 2004 (DE) ..... 10 2004 058 573

(51) Int. Cl.
*D01G 37/00* (2006.01)

(52) U.S. Cl. ..... 19/159 R

(58) Field of Classification Search ..... 19/150, 19/157, 159 A, 159 R
See application file for complete search history.

(56) References Cited

U.S. PATENT DOCUMENTS

| | | | | |
|---|---|---|---|---|
| 1,910,103 | A * | 5/1933 | Gunter et al. | 19/159 R |
| 2,770,016 | A * | 11/1956 | Dudley | 19/159 R |
| 2,832,999 | A | 5/1958 | Whitehurst | |
| 3,105,996 | A * | 10/1963 | Naegeli | 191/159 R |
| 3,169,279 | A | 2/1965 | Noda et al. | |
| 4,236,279 | A | 12/1980 | Kawaura | |
| 4,777,701 | A | 10/1988 | Mori | |
| 5,287,598 | A * | 2/1994 | Gunter et al. | 19/159 R |
| 5,317,786 | A * | 6/1994 | Oexler et al. | 19/159 R |
| 5,737,807 | A * | 4/1998 | Friedrich | 19/159 R |
| 6,694,572 | B2 * | 2/2004 | Cherif et al. | 19/159 R |

FOREIGN PATENT DOCUMENTS

| | | |
|---|---|---|
| CH | 384 321 | 11/1964 |
| DE | 26 07 851 A1 | 9/1976 |
| DE | 28 41 678 A1 | 4/1980 |
| DE | GM 80 07 814 U1 | 6/1980 |
| DE | 36 24742 A1 | 2/1988 |
| DE | 41 43 345 A1 | 6/1993 |
| DE | 42 33 369 A1 | 4/1994 |
| DE | 101 27 815 A1 | 12/2002 |
| EP | 0 670 281 A2 | 9/1995 |

* cited by examiner

*Primary Examiner*—Shaun R. Hurley
(74) *Attorney, Agent, or Firm*—Venable LLP; Robert Kinberg; Steven J. Schwarz

(57) ABSTRACT

In a coiler plate for sliver-coiling devices, especially of draw frames and carding machines, having a sliver channel with an inlet and an outlet for sliver and having a rotary plate, there is present on the underside of the rotary plate a cover which has a through opening. In order to create a coiler plate in a simple manner, a connection piece having a through opening is formed integrally with the cover by deformation.

22 Claims, 4 Drawing Sheets

COILER PLATE FOR SILVER-COILING DEVICES, ESPECIALLY OF DRAW FRAMES AND CARDING MACHINES

CROSS REFERENCE TO RELATED APPLICATION

This application claims priority from German Patent Application No. 10 2004 058 573.3 dated Dec. 3, 2004, the entire disclosure of which is incorporated herein by reference.

BACKGROUND OF THE INVENTION

The invention relates to a coiler plate for sliver-coiling devices, especially of draw frames and carding machines.

In general, coiler plates have a sliver channel with an inlet and an outlet for sliver and a rotary plate, there being present on the underside of the rotary plate a cover which has a through opening. In a known coiler plate (EP-A-0 670 281), a round tube, as starting material, is formed by shaping to form a three-dimensionally curved sliver channel. In the semi-finished product, the outlet bend is followed by a straight portion which is separated during completion of the sliver channel. The outlet of the sliver channel is so constructed that it terminates level with the base of the rotary plate. The base of the rotary plate has a through opening, the internal diameter of which is greater than the external diameter of the outlet of the sliver channel, so that a distancing space is created. The distancing space and the opening are introduced when the rotary plate is being cast. The panel-shaped cover of the rotary plate on its underside likewise has a through opening, the internal diameter of the cover terminating flush with the outer wall of the sliver tube outlet. During assembly, the outlet of the sliver tube outlet is inserted through the opening in the rotary plate into the opening of the cover. A casting material is then poured in so that the sliver channel is fixed at an outlet by the casting material, the pour-in site being so covered by the panel-shaped cover that only the free cross-section of the sliver channel is free. A disadvantageous aspect is the considerable effort required in terms of manufacturing and assembly. In particular, the distancing space, which is approximately elliptical in cross-section, has to be introduced into the rotary plate. In addition, care must be taken when sealing the sliver channel into the rotary plate with the casting material. The casting material is expensive. A further problem is the considerable amount of time required to close the gap space between the rotary plate and the sliver tube outlet. Sharp edges and transitions require laborious polishing.

It is an aim of the invention to provide a coiler plate of the kind described at the beginning which avoids or mitigates that mentioned disadvantages, which has a particularly simple construction and which allows simple manufacture and assembly.

SUMMARY OF THE INVENTION

The invention provides a coiler plate for a sliver-coiling device for a spinning preparation machine, comprising:

a rotary plate;

a sliver channel having an inlet and an outlet; and a cover on an underside of the rotary plate and having a through opening for sliver, wherein the cover comprises a connection piece, including the through opening, formed with the cover.

Because a connection piece having a through opening is formed with the cover, especially by a shaping step, the openings and the connecting element for the sliver channel outlet can be integrated into the cover. The opening, which may be, for example, approximately kidney-shaped, is advantageously produced from the sheet-form cover by non-cutting shaping, a clean transition being created between the flat cover surface and the contours of the opening, so that subsequent machining work is completely or largely unnecessary. In particular, there are no problems with adhering fibres or the like.

The connection piece and the opening may be formed, for example, by non-cutting shaping, by pressing, by deep-drawing, especially including pre-drawing and final drawing, by stamping, by flow-forming, by flow-drilling, or by transfer moulding. Advantageously, the cover is pre-perforated, for example, by cutting, especially laser cutting. The pre-perforated opening may be, for example, approximately kidney-shaped, circular or approximately oval. Advantageously, the cover is heated before and/or during shaping. Advantageously, the sliver channel consists of special steel. Advantageously, the rotary plate consists of cast material, for example cast aluminium. Advantageously, the cover is formed from a wear-resistant material. Advantageously, the cover is formed from a low-friction material. Advantageously, the cover consists of metal, for example, special steel. Advantageously, the cover is in sheet-form. Instead, the cover may consist of a deformable plastics material, especially a plastics material that is wear-resistant and low-friction. Advantageously, the plastics material is wear-resistantly reinforced. Advantageously, the surface of the cover in contact with the coiled fibre material is wear resistant and low-friction. The opening in the cover may be, for example, approximately kidney-shaped, or the cover is substantially oval. Advantageously, the cross-section of the connection piece is partly kidney-shaped. Advantageously, the cross-section of the connection piece in the inlet region conforms to the outlet cross-section of the sliver channel. Advantageously, the outlet cross-section of the sliver channel is substantially oval. Advantageously, the cross-section of the connection piece in the inlet region is substantially oval. Advantageously, the cross-section of the sliver channel outlet and the cross-section of the connection piece in the inlet region are substantially circular. Advantageously, the connection piece is integrated into the cover. Advantageously, the kidney-shaped or oval opening is integrated into the cover. Advantageously, the connecting element (connection piece, passageway) for the outlet of the sliver channel is integrated into the cover. Advantageously, the outlet of the sliver channel is introducible, especially pushable, into the upper region of the connection piece. Advantageously, between the outlet of the sliver channel and the inlet region of the connection piece there is a transfer tube, guide element or the like. The inlet cross-section of the connection piece may be arranged parallel to the cover. The inlet cross-section of the connection piece and the cover may be arranged at an angle to one another. Advantageously, the sliver outlet and the inlet region of the transfer tube, guide element or the like are joined to one another. Advantageously, the outlet region of the transfer tube, guide element or the like and or the inlet of the connection piece are joined to one another. Advantageously, there is a space (gap) between the outlet of the transfer tube, guide element or the like and the inlet of the connection piece. Advantageously, there is a seal between the outlet of the sliver channel and the connection piece. Advantageously, the seal is formed by silicone or the like. Advantageously, the seal is formed by an adhesive or the like. Advantageously, the outlet of the sliver channel and the upper inner region of the connection piece overlap one another. Advantageously, there is a spacer element or the like between the outlet of the sliver channel and the upper inner region of the connection piece. Advantageously, sliver channels having outlets of different diameters are insertable into the connection piece. Advantageously, the sliver channel is joined, for example joined directly, to the connection piece. Advantageously, the sliver channel is joined to the connection piece by means of a connecting element, for example a connecting tube, transfer tube, guide element or the like. Advantageously, the outlet region of the sliver channel is associated with a sliver separation device. Advantageously, the connecting tube, transfer tube, guide element or the like is associated with a sliver separation device. Advantageously, there is a sliver separation device between the outlet of the sliver channel and the inlet of the connection piece.

The invention also provides a coiler plate for sliver-coiling devices, especially of draw frames and carding machines, having a sliver channel with an inlet and an outlet for sliver and having a rotary plate, there being present on the underside of the rotary plate a cover which has a through opening, wherein a connection piece having a through opening is formed integrally with the cover by shaping.

DETAILED DESCRIPTION OF PREFERRED EMBODIMENTS

Figure 1:
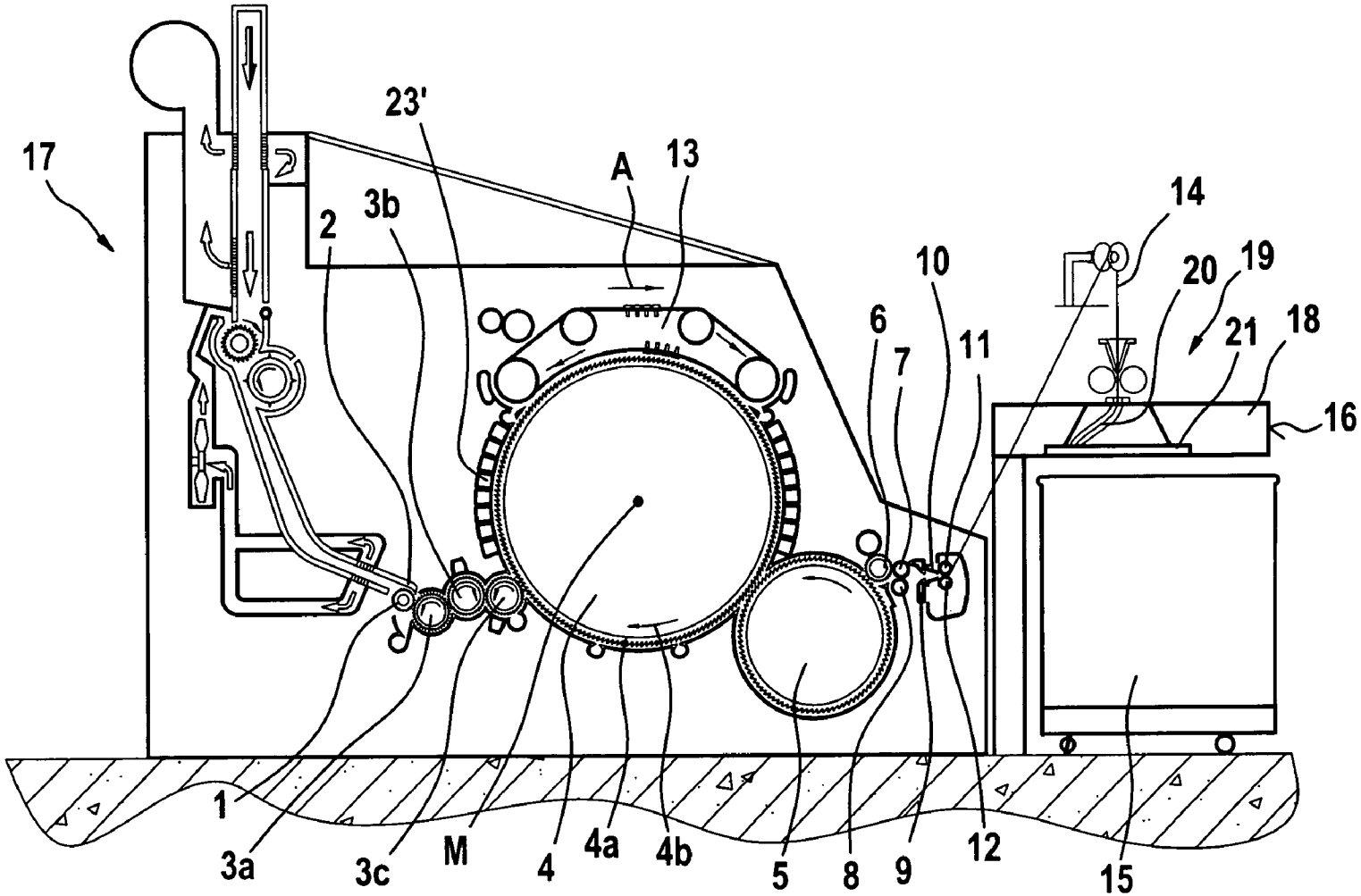
FIG. 1 is a diagrammatic side view of a carding machine with a can coiler that comprises a coiler plate for sliver in accordance with the invention.

FIG. 1 shows a carding machine, for example a TC 03 (trademark) carding machine made by Trützschler GmbH & Co. KG of Mönchengladbach, Germany, having a feed roller 1, feed table 2, lickers-in 3*a*, 3*b*, 3*c*, cylinder 4, doffer 5, stripper roller 6, nip rollers 7, 8, web guide element 9, sliver funnel 10, delivery rollers 11, 12, revolving card top 13 with card top guide rollers and card top bars, can 15 and can coiler 16. The directions of rotation of the rollers are indicated by curved arrows. Reference letter M denotes the centre point (axis) of the cylinder 4. Reference numeral 4*a* indicates the clothing and reference numeral 4*b* indicates the direction of rotation of the cylinder 4. Arrow A denotes the operating direction. A flock feed device 17 is arranged upstream of the carding machine. The coiler plate 19 is rotatably mounted in the coiler plate panel 18. The coiler plate 19 comprises a sliver channel 20 with an inlet and an outlet (see FIG. 3) for sliver and a rotary plate 21 having a cover 22 on its underside (see FIG. 3). A connection piece 23 is formed integrally with the cover 22 (see FIG. 3). On simultaneous rotation of the can 15, the sliver 14 is coiled cycloid ally in the can 15, so that the can 15 can be filled uniformly with sliver.

Figure 2:
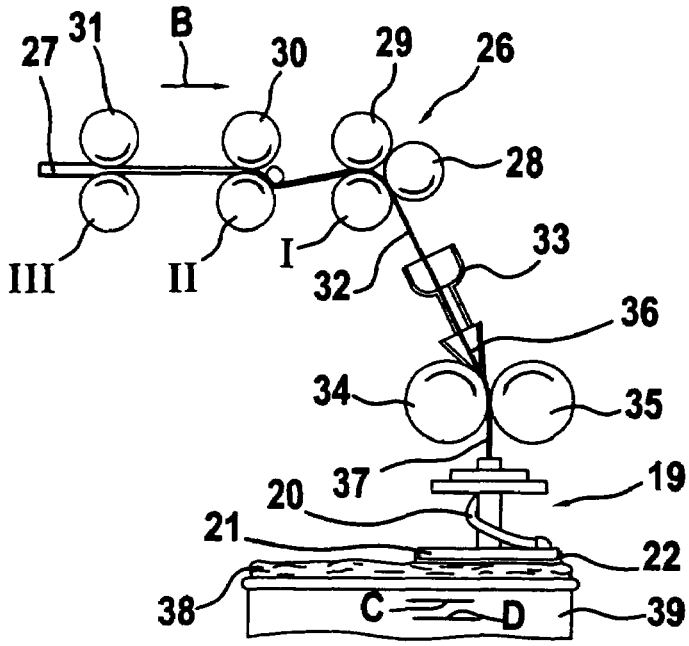
FIG. 2 is a diagrammatic side view of the drafting system of a draw frame having a coiler plate for sliver in accordance with the invention.

According to FIG. 2, a draw frame, for example a TD 03 (trademark) made by Trützschler GmbH & Co. KG, has a drafting system 26 having a drafting system inlet and a drafting system outlet. The slivers 27, coming from cans (not shown), enter a sliver guide means and, drawn by the delivery rollers, are transported past a measuring element. The drafting system 26 is configured as a 4 over 3 drafting system, that is to say it consists of three lower rollers I, II, III (I output lower roller, II middle lower roller, III input lower roller) and four upper rollers 28, 29, 30, 31. In the drafting system 26, the drafting of the fibre bundle 27, which consists of several slivers, is carried out. The drafting operation is composed of the preliminary drafting operation and the main drafting operation. The roller pairs 31/III and 30/II form the preliminary drafting zone and the roller pairs 30/II and 28,29/I form the main drafting zone. In the drafting system outlet, the drafted slivers (fibre web 32) arrive at a web guide means 33 and are drawn by means of delivery rollers 34, 35 through a sliver funnel 36 in which they are combined to form a sliver 37, which is then coiled, by way of a can coiler 16 and coiler plate 19, in sliver rings 38 in a can 39. The can 39 is in the form of a rectangular can and in the course of sliver coiling moves in the direction of arrows C and D underneath the coiler plate. The coiler plate 19 comprises a three-dimensionally curved sliver channel 20 for sliver 37 and a rotary plate 21 having a cover 22 on its underside. A connection piece 23 is formed integrally with the cover 22. Reference letter A denotes the running direction of the sliver bundle 27 through the drafting system 26. The coiler plate 19 is arranged in a coiler plate panel 18 (not shown in FIG. 2) which corresponds substantially to the coiler plate panel 18 in FIG. 1.

Figure 3:
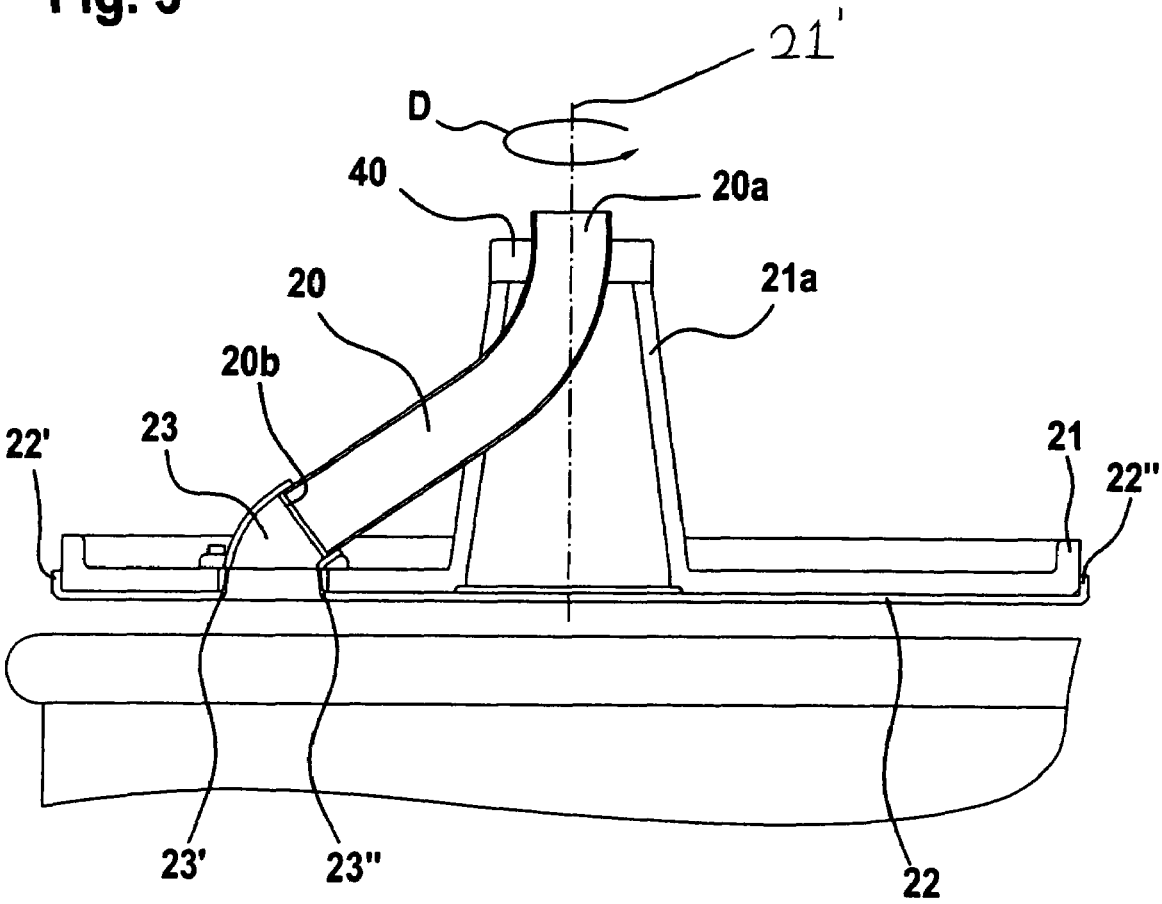
FIG. 3 is a coiler plate with a sliver can in longitudinal section, in which a connection piece is formed integrally with the cover of the rotary plate.

According to FIG. 3, the sliver 37 (see FIG. 2) enters the inlet 20*a* of the three-dimensionally curved sliver channel 20, passes through the sliver channel 20 and then emerges from the sliver channel 20 again at outlet 20*b*. The sliver channel 20 is arranged eccentrically in the rotary plate 21. During the coiling of the sliver, the rotary plate 21 rotates in the direction of arrow D about a rotational axis $\mathbf{21}^1$. The rotation of the rotary plate 21 about the rotary can 39 brings about circular (ring-shaped) coiling of the sliver in the can 39.

A casting material 40 joins the sliver channel 20 in the region of its inlet 20*a* to a plate holder 21*a*. The sliver channel 20 is provided at its outlet 20*b* with a connection piece 23. It may be advantageous to fix and/or seal the outlet 20*b* in the inlet opening 23*a* of the connection piece 23, for example by means of silicone, adhesive or the like. The underside of the rotary plate 21 is provided with a cover 22, for example a cover sheet of special steel. Special steel is wear-resistant and low in friction with respect to the sliver 38 coiled in the can 39. In addition, mechanical machining (sanding, polishing) of the base of the rotary plate 21, which, preferably in the form of a cast article, consists of aluminium or an aluminium alloy, is avoided. The cover 22 is arranged to lie closely against the underside of the rotary plate 21 and is affixed, for example, by adhesive bonding. The edge 22', 22" of the cover 22 is bent up and rests against the rotary plate 21. A connection piece 23 having a through opening is formed integrally with the cover 21, the opening being configured for the passage of the sliver. The transitions 23', 23" at the outlet of the drafting system 23 are rounded.

Figure 4:
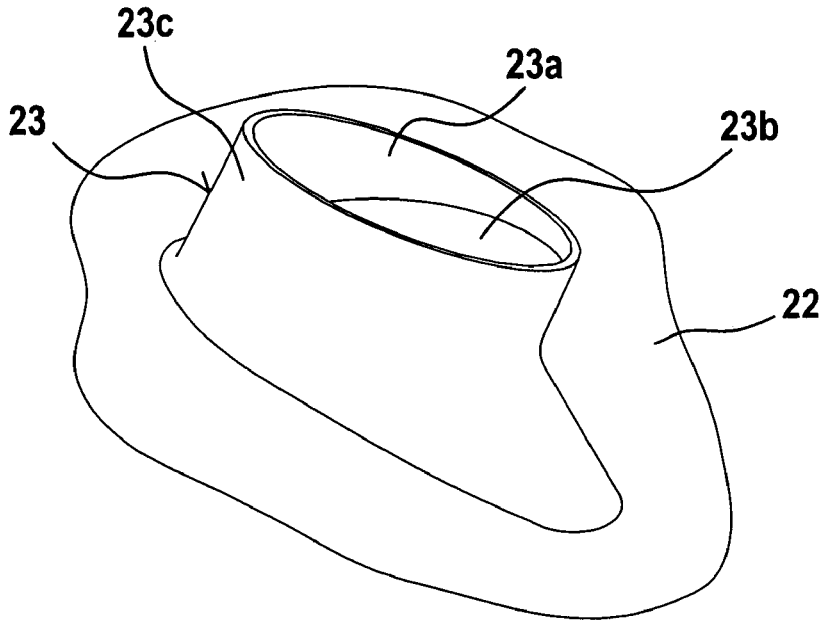
FIG. 4 is a perspective view of the connection piece formed integrally with the cover.

According to FIG. 4, the connection piece 23 has an inlet opening 23*a*, an outlet opening 23*b* and a wall 23*c*. The exemplary embodiment has a circular inlet opening 23*a* and an approximately kidney-shaped outlet opening 23*b* in the region of the cover 22. The connection piece 23 is formed integrally with the sheet-form cover 22 by non-cutting shaping, for example by pressing or deep-drawing. The transition from the flat sheet-form cover 22 to the wall 23*c* is advantageously rounded, so that fibre material cannot adhere. The sliver passes through the interior of the connection piece 23, that is to say the connection piece 23 is continuously open on the inside.

Figure 5:
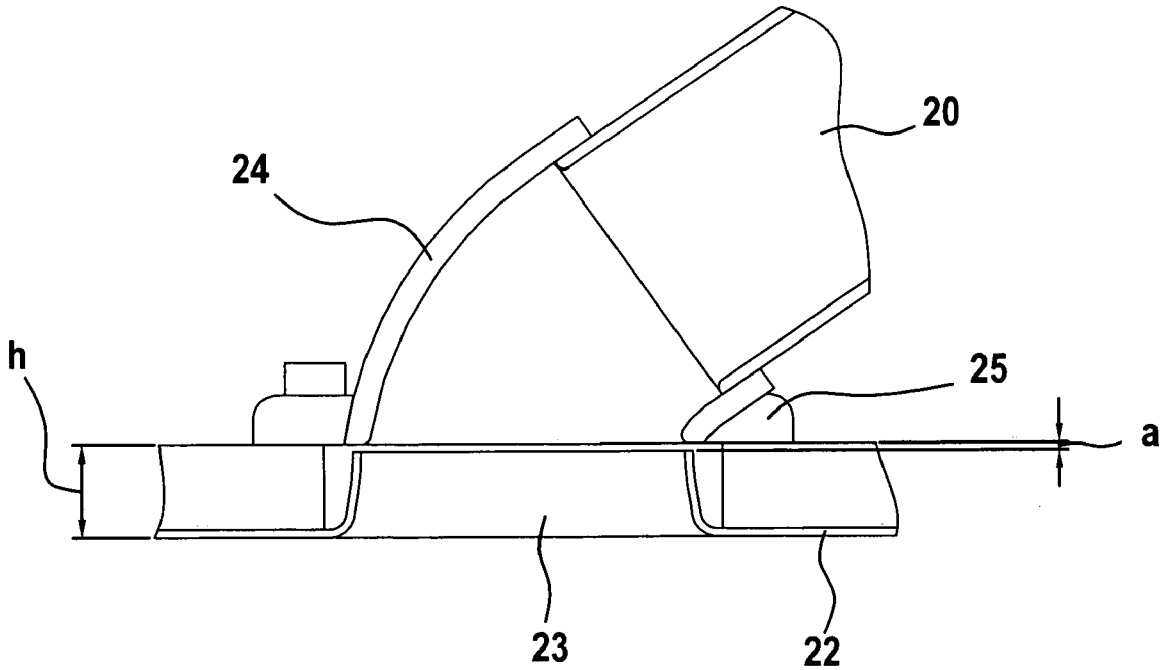
FIG. 5 shows an embodiment in which a guide element is present between the connection piece and the sliver channel.

In accordance with FIG. 5, between the outlet 20*b* of the sliver channel 20 and the inlet 23*a* of the connection piece 23 there is a guide element 24 or the like, which is approximately in the shape of a tube elbow or the like. The guide element 24 can consist, for example, of a preferably wear-resistant casting and can be affixed to the rotary plate 21 by means of a fastening 25. The upper edge at the inlet 23*a* of the connection piece 23 and the flat cover panel at the outlet 23*b* of the connection piece 23 are arranged parallel to one another. The height h of the wall 23*c* can be small, which is advantageous from the manufacturing standpoint. Between the outlet 20*b* and the inlet 23*a* there is a small gap a, which can be associated with a separating wall (not shown) for the sliver. The construction shown in FIG. 5 can be modified so that there is no gap a, but instead the outlet 24*a* is connected to the inlet opening 23*a*. In that case, a sliver separation means, for example mechanical, pneumatic or the like, can be associated with the guide element 24.

Figure 6:
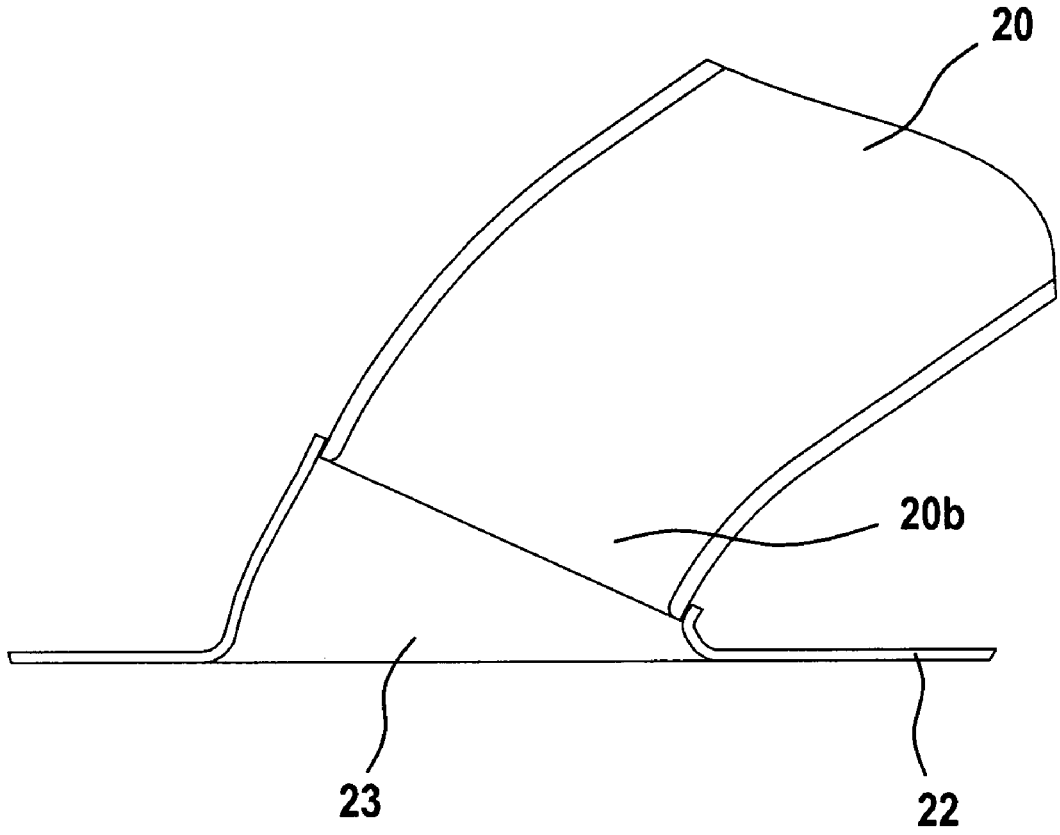
FIG. 6 shows a further embodiment in which the sliver channel is in engagement with the connection piece.

The embodiment according to FIG. 6 corresponds substantially to the construction shown in FIG. 3. The region of the outlet 20*b* of the sliver channel 20 can be associated with a sliver separation means (not shown) for the sliver. Sliver separation can be implemented, for example, pneumatically by means of compressed air which is passed through the wall surfaces of the outlet 20*b* (or the guide element 24 according to FIG. 5).

The drafting system 26 shown in FIG. 2 can be used both for a draw frame, for example TC 03, and at the outlet of a carding machine according to FIG. 1 between delivery rollers 11, 12 and can coiler 19. In a draw frame, the drafting system 26 effects drafting of a sliver 27 consisting of a plurality of slivers to form a single drafting system sliver 37 and in a carding machine the single card sliver 14 that emerges from the delivery rollers 11, 12 and can be coiled in the can 15.

Although the foregoing invention has been described in detail by way of illustration and example for purposes of understanding, it will be obvious that changes and modifications may be practised within the scope of the appended claims.

What we claim is:

1. A coiler plate for a sliver-coiling device for a spinning preparation machine, comprising: a rotary plate defining an aperture; a sliver channel having an inlet and an outlet; and a cover on an underside of the rotary plate and having a through opening for sliver, wherein the cover comprises a connection piece, including the through opening, formed with the cover, the connection piece extending upwardly from the underside of the rotary plate at least partially through the aperture in the rotary plate.

2. A coiler plate according to claim 1, in which the connection piece is formed by a shaping process.

3. A coiler plate according to claim 1, in which the connection piece is formed by non-cutting deformation.

4. A coiler plate according to claim 1, in which the connection piece and the opening are formed by a method selected from the group consisting of pressing; deep-drawing; stamping; flow-forming; flow-drilling; and transfer moulding.

5. A coiler plate according to claim 4, in which the connection piece and the opening are formed with the cover by deep-drawing comprising pre-drawing and final drawing.

6. A coiler plate according to claim 1, in which the opening is laser cut in the cover.

7. A coiler plate according to claim 1, in which the opening is approximately kidney-shaped.

8. A coiler plate according to claim 1, in which the cover is heated before and/or during the deformation.

9. A coiler plate according to claim 1, in which the sliver channel consists essentially of special steel.

10. A coiler plate according to claim 1, in which the rotary plate consists essentially of cast aluminium.

11. A coiler plate according to claim 1, in which the cover consists essentially of metal or a deformable plastics material.

12. A coiler plate according to claim 1, in which the cover is formed from a sheet-material.

13. A coiler plate according to claim 1, in which the surface of the cover in contact with the coiled fibre material is wear-resistant and low-friction.

14. A coiler plate according to claim 1, in which the cross-section of the connection piece in the inlet region conforms to the outlet cross-section of the sliver channel.

15. A coiler plate according to claim 1, in which the connection piece is formed in one piece with the cover.

16. A coiler plate according to claim 1, in which a structure defining the opening is formed in one piece with the cover.

17. A coiler plate according to claim 1, in which the outlet of the sliver channel is interconnected with the upper region of the connection piece.

18. A coiler plate according to claim 1, in which between the outlet of the sliver channel and the inlet region of the connection piece there is a connection element.

19. A coiler plate according to claim 1, in which there is a seal between the outlet of the sliver channel and the connection piece.

20. A coiler plate according to claim 1, in which the outlet of the sliver channel is inserted into the upper inner region of the connection piece such that the outlet of the sliver channel and the upper inner region of the connection piece at least partially overlap one another.

21. A coiler plate according to claim 1, in which the connection piece is adapted to receive sliver channels having outlets of different diameters.

22. A coiler plate according to claim 1, further comprising a sliver separation device at or in the vicinity of the outlet region of the sliver channel.

* * * * *